United States Patent [19]

Smith

[11] Patent Number: 5,056,993

[45] Date of Patent: Oct. 15, 1991

[54] LIQUID INTAKE MECHANISM FOR ROTARY VANE HYDRAULIC MOTORS

[76] Inventor: Roger R. Smith, 7261 Lyons Rd., Imlay City, Mich. 48444

[21] Appl. No.: 616,146

[22] Filed: Nov. 20, 1990

Related U.S. Application Data

[63] Continuation of Ser. No. 28,154, Mar. 17, 1987, abandoned.

[51] Int. Cl.[5] ..... F01C 1/00; F16L 9/00

[52] U.S. Cl. ..... 418/259; 138/178

[58] Field of Search ..... 418/15, 150, 259; 138/177, 178, DIG. 11

[56] References Cited

U.S. PATENT DOCUMENTS

| | | | |
|---|---|---|---|
| 784,614 | 3/1905 | Buchanan | 418/15 |
| 1,014,162 | 1/1912 | McCormick | 418/268 |
| 2,037,358 | 4/1936 | Amtsberg | 418/268 |
| 2,216,053 | 9/1940 | Staley | 418/268 |
| 2,541,405 | 2/1951 | Chapman | 418/266 |
| 2,705,459 | 4/1955 | Dunning | 418/267 |
| 2,778,317 | 1/1957 | Cockburn | 418/266 |
| 3,909,158 | 9/1975 | Martin | 418/269 |
| 3,934,657 | 1/1976 | Danielson | 418/270 |
| 4,088,426 | 5/1978 | Edwards | 418/15 |
| 4,413,963 | 11/1983 | Maruyama | 418/259 |
| 4,515,514 | 5/1985 | Hayase | 418/150 |
| 4,787,421 | 11/1988 | Yu | 138/DIG. 11 |

*Primary Examiner*—Richard A. Bertsch
*Assistant Examiner*—David L. Cavanaugh
*Attorney, Agent, or Firm*—Peter A. Taucher; David L. Kuhn

[57] ABSTRACT

A rotary vane hydraulic motor wherein pressurized liquids are admitted to the working chambers through intake passages oriented tangentially to the rotor peripheral surface. Each intake passage has two flat parallel side surfaces spaced apart approximately the transverse width of the working chamber, such that the liquid readily fills the chamber width dimension as it enters the chamber, without excessive turbulence or flow disruptions.

11 Claims, 3 Drawing Sheets

LIQUID INTAKE MECHANISM FOR ROTARY VANE HYDRAULIC MOTORS

GOVERNMENT INTEREST

The invention described herein may be manufactured, used, and licensed by or for the Government for governmental purposes without payment to me of any royalty thereon.

This is a continuation of application Ser. No. 07/028,154 filed Mar. 17, 1987, now abandoned.

SUMMARY OF THE INVENTION

This invention relates to hydraulic motors, especially motors of the rotary vane type.

One problem with existing vane type hydraulic motors is their inefficiency at higher rotational speeds (revolutions per minute). In the lower speed ranges such motors operate essentially as hydrostatic devices, i.e. by liquid pressure. In the higher speed ranges such motors operate primarily as hydrodynamic devices, i.e. by liquid flow forces.

In conventional motors, flow constrictions at the motor intake passages tend to prevent the liquid flow from keeping pace with the rotor speed, especially at high rotor speeds. The intake passages are relatively inefficient liquid guide structures. Turbulence, flow instability, and excessive pressure loss are common problems.

My invention concerns an improved liquid intake means for rotary vane motors, whereby such motors are enabled to have improved operating efficiencies over the entire operating speed range, i.e. the hydrostatic range and the hydrodynamic range. With my improved intake passage means the hydraulic motor tends to operate both as a hydrostatic device and a hydrodynamic device over the entire operating speed range.

One object of my invention is to provide a liquid intake means wherein the liquid experiences minimum turbulence as it enters the expansion chamber in the motor.

Another object of my invention is to provide a liquid intake means that produces a relatively smooth liquid flow over the entire speed range of the motor.

A further object of the invention is to provide a liquid intake means that produces minimal direction changes in liquid flow as the liquid is being introduced to the expansion chamber in the motor.

Another object is to provide a liquid intake means wherein the liquid flow rate is sufficient to keep the working chambers in the motor filled with pressurized liquid, even at high motor speeds.

A further object of my invention is to provide a liquid intake means that will contribute to a relatively high motor torque over the entire speed range of the motor.

THE DRAWINGS

FIG. 1 is a sectional view through a hydraulic motor embodying my invention.

FIGS. 2 through 6 are fragmentary sectional views on lines 2—2, 3—3, 4—4, 5—5 and 6—6 in FIG. 1.

FIGS. 1, 2 AND 6

Figure 1:
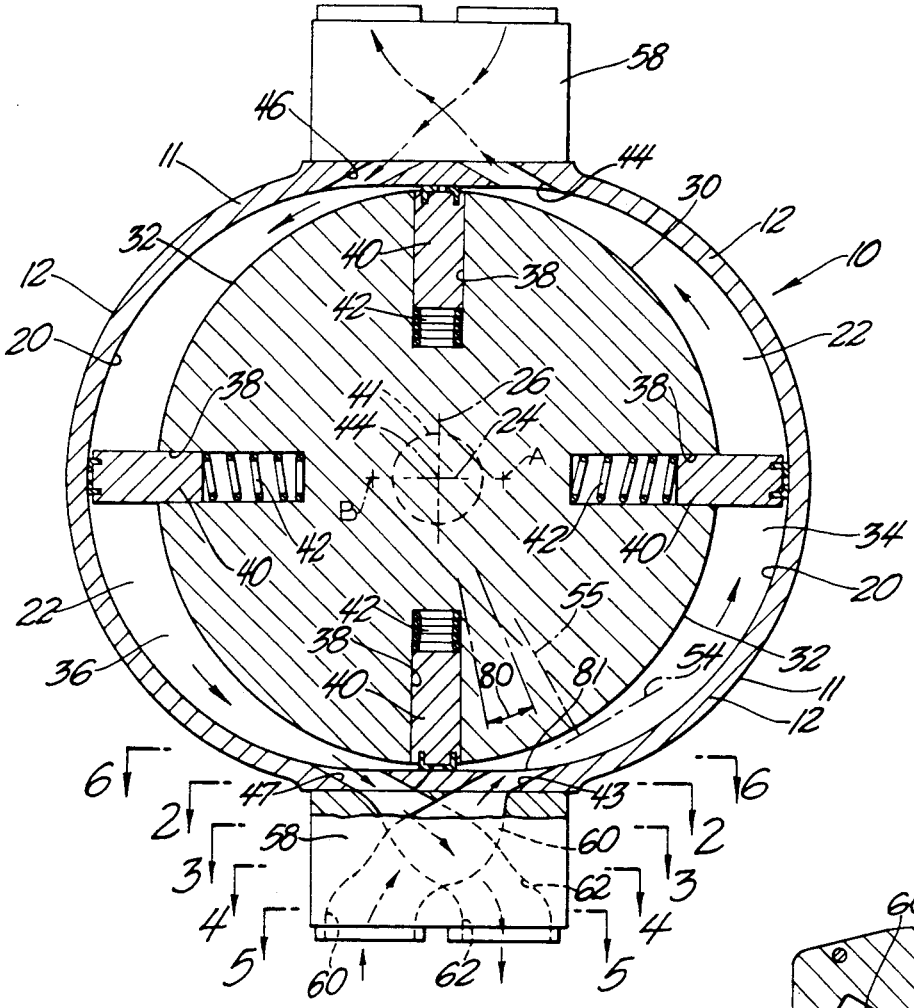
Figure 2:
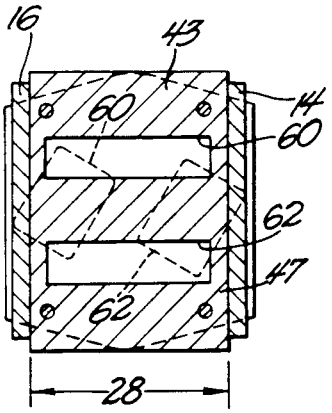
Figure 6:
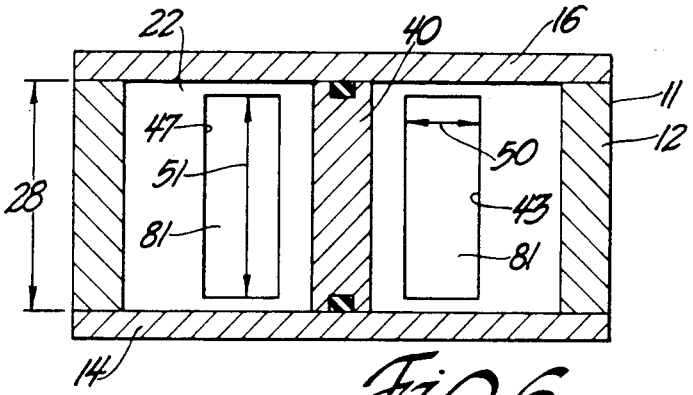

FIGS. 1, 2 and 6 illustrate a hydraulic motor 10 embodying my invention. The motor comprises a housing 11 that includes an annular circumferential wall 12 arranged between two parallel flat plates (side walls) 14 and 16. The parallel plates are not visible in FIG. 1, but are shown in FIGS. 2 and 6. These plates have the same outline shape as the intervening annular wall 12.

The interior surface 20 of wall 12 forms a two-lobed epitrochoidal cavity .22 having a major axis 24 and a minor axis 26. Cavity 22 has a transverse (axial) dimension corresponding to the spacing between side plates 14 and 16, i.e. dimension 28 in FIGS. 2 and 6.

Disposed within housing 11 is a hydraulically-driven rotor means 30. Rotor means 30 comprises a large cylindrical hub element 32 having an axial dimension 28 (FIG. 2). Element 32 has a diameter corresponding to the dimension of cavity 22 taken along minor axis 26, such that element 32 divides the cavity 22 into two segmental chambers 34 and 36.

Rotor hub element 32 has four radial slots 38 therein spaced equidistantly around its circumference. Each slot slidably accommodates a vane 40 therein. A spring means 42 biases each vane radially outwardly from the rotor element rotational axis 44, such that the outer edge of each vane is slidably (sealably) engaged with the interior surface 20 of cavity wall 12. The lateral side edges of the vanes are slidably (sealably) engaged with the inner surfaces of plates 14 and 16.

The introduction of pressurized liquid into segmental chambers 34 and 36 causes the rotor means 30 (members 32 and 40) to rotate around axis 44. A shaft 41 extends from member 32 through an opening in wall 16 to deliver rotary power to any suitable load device.

LIQUID INTAKE AND LIQUID EXHAUST

Pressurized liquid is admitted to segmental chamber 34 through a liquid intake passage 43 extending through housing wall 12. Spent liquid is exhausted from chamber 34 through a liquid exhaust passage 44 formed in wall 12 (displaced approximately one hundred eighty degrees from passage 43).

Pressurized liquid is admitted to segmental chamber 36 through a liquid intake passage 46 extending through wall 12. Spent liquid is exhausted from chamber 36 through a liquid exhaust passage 47 formed in wall 12 (approximately one hundred eighty degrees from passage 46).

Each one of passages 43, 44, 46 and 47 has a rectangular cross-section (taken normal to the direction of flow). Each passage intersects the interior surface 20 of wall 12 to form a rectangular port 80. FIG. 6 shows the internal port configuration for passages 43 and 47. The other passages 44 and 46 would have similar internal port configurations.

Each passage 43, 44, 46 or 47 (and associated port) has a relatively small dimension 50 (FIG. 6) in the circumferential direction, and a relatively large dimension 51 in the axial plane (i.e. parallel to the rotor rotational axis). Each passage spans substantially the entire distance 28 between housing walls 14 and 16 (i.e. the transverse width of the segmental chamber 34 or 36).

As best seen in FIG. 1, each passage 43, 44, 46 or 47 extends through housing wall 12 at an acute angle to the general plane of the wall. The passage angle is selected so that each passage centerline is approximately tangent to the surface of cylindrical hub element 32. In FIG. 1 the imaginary centerline 54 for passage 43 is shown to be normal to a radial line 55 generated from axis 44, such that passage 43 extends generally tangent to the surface of cylindrical element 32. The aim is to cause the pressurized liquid to flow generally parallel to the surface of element 32 as it enters segmental chamber 34.

PIPING CONNECTIONS

The passages 43 and 47 have intersecting centerlines. Similarly, passages 44 and 46 have intersecting centerlines. The separate flowing liquids must pass one another without intermixing, and without interference or constricting effects. Abrupt changes in flow velocity or flow direction before (or after) the liquid passes through a given passage 43, 44, 46 and 47 should be avoided if at all possible. FIGS. 1 through 5 illustrate a piping connector mechanism 58 that can be used to minimize abrupt changes in velocity or direction as the liquid flows between the external piping system (not shown) and respective ones of passages 43, 44, 46 and 47.

FIG. 1 illustrates two piping connectors 58, one for passages 43 and 47, and another for passages 44 and 46. The connectors are similarly constructed; therefore a description of one connector 58 will suffice for a description of the other.

Each connector 58 is internally configured to define two separate flow ducts 60 and 62. Duct 60 connects with passage 43, whereas duct 62 connects with duct 47. Duct 60 is an inflow connection from a non-illustrated pipe used to supply pressurized liquid to the motor. Duct 62 is an outflow connection to a second non-illustrated pipe used to exhaust spent liquid from the motor.

Each duct 60 or 62 has a circular cross section at the point where it connects to the piping system, and a rectangular cross-section at the point where it joins the respective passage 43 or 47. Each duct causes the liquid stream to transition between circular and rectangular cross sectional patterns; changes in duct contour are made as gradual as possible in order to avoid abrupt changes in flow cross-section.

Figure 3:
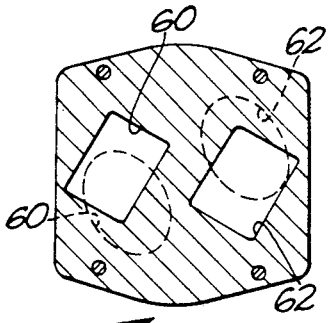
Figure 4:
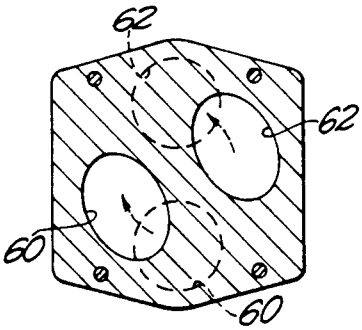
Figure 5:
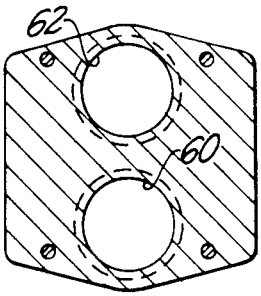

Each duct 60 or 62 undergoes a gradual angular (directional) change between its apposite ends, whereby the ducts can curl around one another without abrupt changes in flow cross sectional area. Each of FIGS. 2, 3 and 4 illustrates angular (directional) changes in the ducts by showing the duct orientation in two different planes (sections).

FIG. 2 shows the cross sectional contour of passages 43 and 47 in full lines, and the cross sectional contour of ducts 60 and 62 on plane 3—3 in dashed lines. FIG. 3 shows the cross sectional contour of ducts 60 and 62 on plane 3—3 in full lines, and the cross sectional contour of ducts 60 and 62 on plane 4—4 in dashed lines. FIG. 4 shows in full lines the cross sectional contour of ducts 60 and 62 on plane 4—4, and in dashed lines the cross sectional contour of the ducts on plane 5—5.

Ducts 60 and 62 preferably have approximately the same cross-sectional (flow) area along their entire lengths, such that the linear flow rate of each liquid stream is approximately constant between the circular cross section external piping system and the rectangular port in wall surface 20. The aim is to avoid abrupt changes in flow direction and flow velocity.

FIG. 11 CONSTRUCTION

Figure 11:
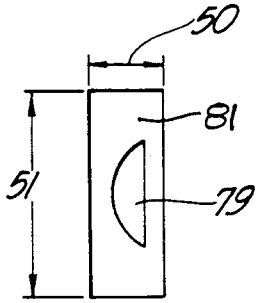
FIG. 11 is a diagram showing relative port areas obtainable with my invention and with prior art practice.

FIG. 11 shows a piping connector 58*a* that can be used in lieu of the piping connector shown in FIGS. 1 through 5. Connector 58 is internally contoured to define circular cross sectioned areas 60*a* and 62*a*, and rectangular cross sectioned areas 60*b* and 62*b*. Each duct area 60*b* or 62*b* is a ninety degree bend that serves to change the flow direction between horizontal and vertical. Duct areas 60*b* and 62*b* have the same cross sectional dimensions (50 and 51) as the mating passages 43 and 47. Duct areas 60*c* and 62*c* are transition duct sections, from circular to rectangular, whereby the flowing liquids experience only gradual variations in cross sectional pattern and velocity as they move to, or from, passages 43 and 47.

FIGS. 7 AND 8

Figure 7:
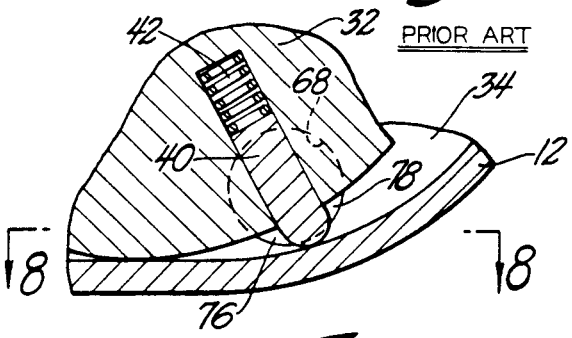
FIG. 7 is a fragmentary sectional view through a hydraulic motor representing conventional prior art practice.
Figure 8:
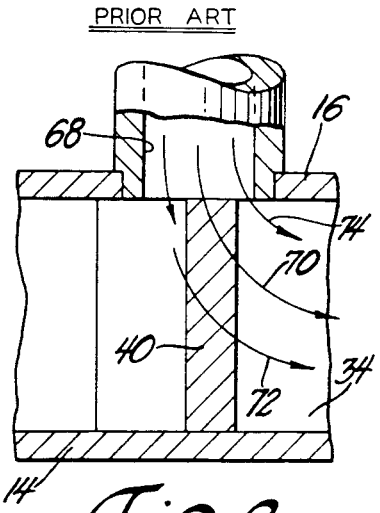
FIG. 8 is a sectional taken essentially on line 8—8 in FIG. 7.

FIGS. 7 and 8 fragmentarily show a conventional liquid intake means used in hydraulic motors. In this case the pressurized liquid flows into segmental chamber 34 through a circular passage 68 extending at right angles to the general plane of the segmental chamber. As the liquid moves out of passage 68 it is forced to make an abrupt ninety degree turn, as indicated by a flow line 70 (assuming vane 40 is not the in line with passage 68). Mass flow rate near wall 14 (denoted by arrow 72) tends to be appreciably higher than the mass flow rate near wall 16 (denoted by arrow 74). Considerable turbulence is generated. At high rotor speeds this turbulence may sufficiently retard the mass flow rate, such that the flowing liquid cannot keep pace with the vane speed. The motor is then inefficiently operating essentially as a hydrodynamic device, rather than as a hydrostatic device.

At those moments in the operating cycle when vane 40 is in line with passage 68 (as shown in FIGS. 7 and 8), the incoming liquid is divided into two streams; one stream flows into the space at the upstream face of vane 40, and the other stream flows into the space at the downstream face of the vane. Numerals 76 and 78 reference the two separate streams. When the vane is in line with the intake passage the thickness dimension of the vane effectively blocks a major portion of the supply passage cross section. Flow into the expansion chamber 34 is severly retarded at the beginning and end of each stroke (cycle).

FIG. 9

Figure 9:
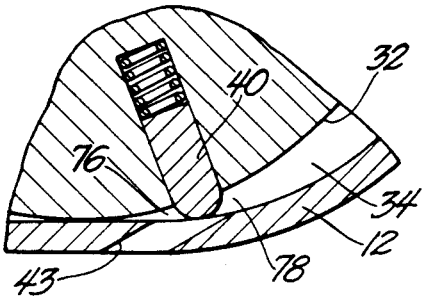
FIG. 9 is a fragmentary sectional view corresponding to FIG. 7, but illustrating features of my invention.
Figure 10:
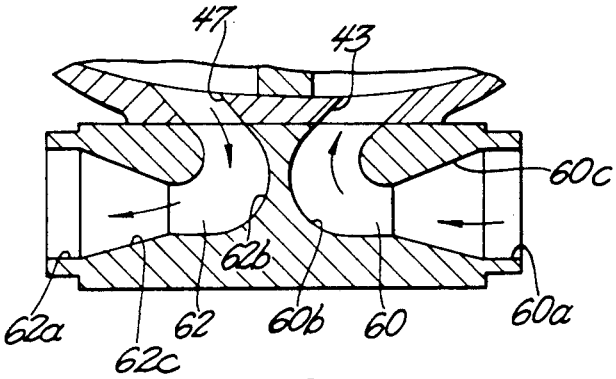
FIG. 10 is a sectional view through a piping connector that can be used with the FIG. 1 motor.

FIG. 9 illustrates the intake arrangement that I propose to use. The liquid flows from passage 43 into chamber 34 along a line tangent to the surface of rotor element 32. Assuming vane 40 is moved out of alignment with passage 43, the liquid flows from passage 43 without experiencing the abrupt directional change denoted by numeral 70 in FIG. 8. Destructive turbulence is avoided.

When vane 40 is in registry with the intake passage (as shown in FIG. 9) the vane thickness does not appreciably obstruct the intake port. The liquid can flow to the upstream face area 76 of the vane and the downstream face area 78 of the vane without appreciable interference from the vane thickness.

My proposed intake arrangement is further advantageous in that an appreciably larger port area is available, compared to the FIG. 7 arrangement. FIG. 11 shows comparative port areas; numeral 79 represents the effective port area with the FIG. 7 arrangement, and numeral 81 represents the port area obtainable with my proposed intake arrangement. The much larger port area available with my proposed arrangement is advantageous in minimizing turbulence and obtaining a complete liquid filling of the expansion chamber.

The large port area is obtained without need for a large port dimension in the circumferential direction. FIG. 1 shows the circumferential dimension 80 of intake port 81, measured from rotational axis 44. Dimension 80 measures approximately twelve degrees. Circumferential port dimensions up to about twenty degrees can be used without adversely affecting motor performance. However, if the circumferential dimension of the intake port is too great the vane will take an abnormally long travel distance to close off the port.

The driving force on rotor 30 is at least partly related to the differential area between the leading vane and the trailing vane. If the trailing vane takes too great a distance to close the intake port the area of the trailing vane will be relatively large in relation to the area of the leading vane when the port is closed; the differential area will be undesirably small. By keeping the circumferential dimension 80 of the intake port relatively small (less than about twenty degrees) is is possible to close the port quickly, thereby maintaining relatively high driving forces on rotor 30.

FIG. 12

Figure 12:
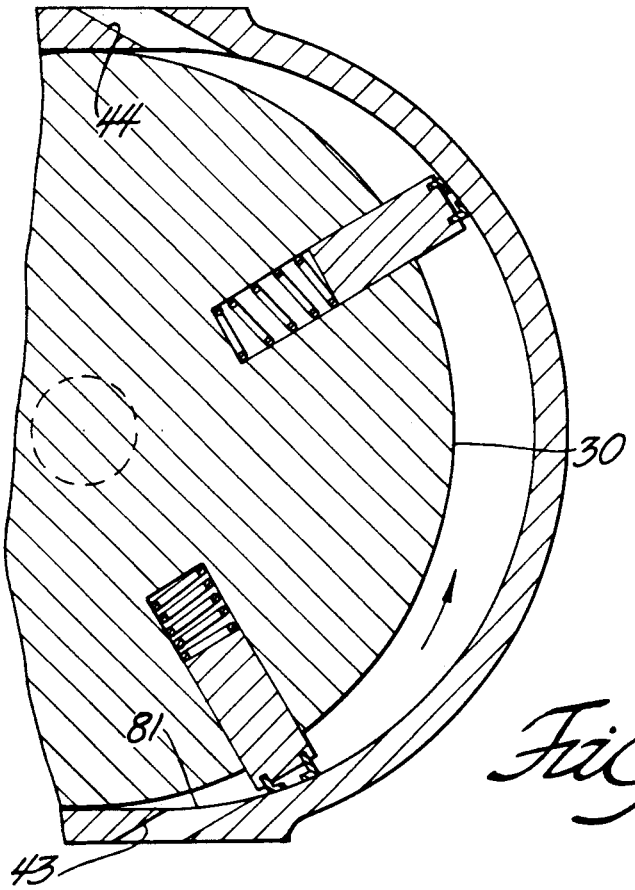
FIGS. 12 & 13 are fragmentary views taken in the same direction as FIG. 1, but illustrating the vanes in different rotated positions.

FIG. 12 shows vane positions just after the trailing vane has closed the intake port 81. The pressurized liquid trapped between the two vanes exerts opposing forces on the vanes, i.e. a retarding force on the trailing vane and a driving force on the leading vane. The effective driving force is related to the area differential between the two vanes. By making the intake port relatively small in the circumferential direction the trailing vane will close off the port while the vane area is still relatively small. This somewhat increases the vane area differential and the effective driving force on rotor 30.

EXHAUST PASSAGE STRUCTURE

The preceding narrative has dealt primarily with the flow characteristics of the two intake passages 43 and 46. However the flow characteristics of the two exhaust passages 44 and 47 are also important to motor performance. The exhaust passages are required to discharge the spent liquid at a high flow rate in order to provide a low pressure condition on the front face of the leading vane. I contemplate that exhaust passages 44 and 47 will be constructed generally similarly to the intake passages 43 and 46, to promote a smooth, non-turbulent flow out of the expansion chambers.

Figure 13:
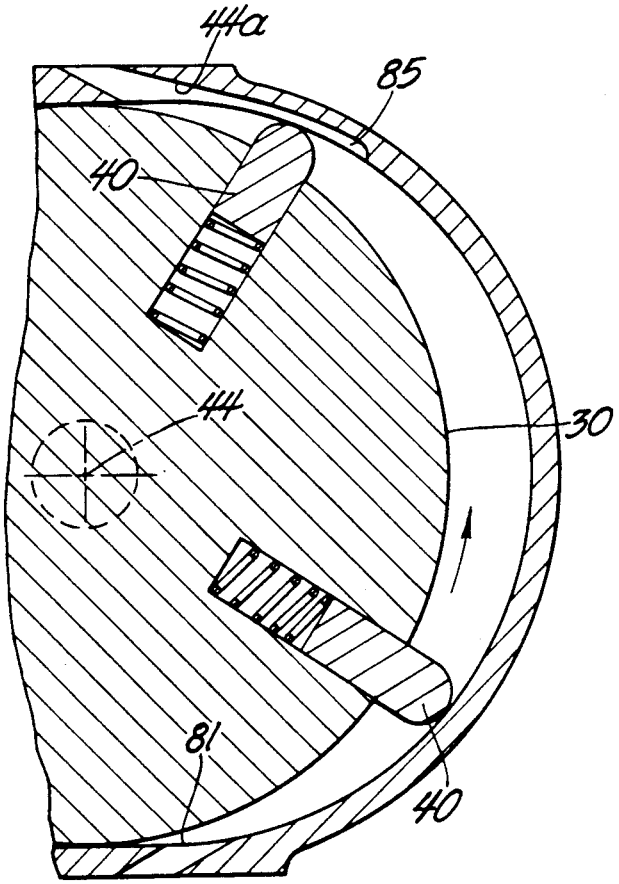

Some variation in the contour on exhaust passages 44 and 47 may be advantageous. FIG. 13 illustrates an exhaust passage structure **44*a* wherein the starting point for the exhaust passage is referenced by numeral 85. With such an arrangement the associated expansion chamber 86** begins to exhaust while the vane differential (between the leading vane and trailing vane) is still balanced in a favorable direction, i.e. the driving force is at least as great as the retarding force.

PRINCIPAL ADVANTAGES OF THE INVENTION

My invention will be advantageous primarily when rotor 30 is in its high speed operating range. The arrangement of passages 43, 44, 46 and 47 promotes a rapid and complete filling (and subsequent exhaustion) of each expansion chamber, with what might be termed a high "gulp" factor. Complete filling of the expansion chamber enables the motor to operate primarily as a hydrostatic device (as opposed to a hydrodynamic device), with relatively high driving pressures being exerted on rotor 30.

The various passages and ports are designed to provide relatively large flow areas for the incoming (and outgoing) liquids. The liquids flow tangentially to the rotor surface, without directional changes. Destructive turbulence is minimized, even though the circumferential dimension of each intake port is relatively small. An important feature is the large axial dimension 51 of each intake port, whereby the port spans substantially the entire distance between housing side walls 14 and 16; since the liquid does not have to expand laterally as it moves through the intake port (orifice) the orifice discharge losses are relatively small. Each intake port preferably is a rectangular port whose axial (transverse) dimension is at least twice as great as its circumferential dimension.

I wish it to be understood that I do not desire to be limited to the exact details of construction shown and described for obvious modifications will occur to a person skilled in the art, without departing from the spirit and scope of the appended claims.

I claim:

1. A hydraulic motor comprising a housing having two parallel side walls, and an interconnecting circumferential wall; the interior surface of the circumferential wall defining a two-lobe epitrochoidal cavity; a rotor disposed within the housing for rotation on a central axis normal to the housing side walls; said rotor comprising a cylindrical hub having radial slots and a radial vane slidably disposed in each slot; the diameter of the cylindrical hub being the same as the minor dimension of the epitrochoidal cavity, the housing and rotor defining segmental working chambers:

the improvement comprising liquid intake means for minimizing turbulence and restrictions in the flow of liquid into the housing, there being a liquid intake means for at least one of the segmental chambers; the liquid intake means comprising an intake passage defined by the housing circumferential wall, the intake passage having a generally rectangular cross section terminating in a rectangular intake port on the wall interior surface; the intake port spanning substantially the entire distance between the two housing side walls; the liquid intake means further comprising a connector affixed to the housing having a duct therethrough such that the duct and the intake passage together form a smooth, continuous passage having a constant cross sectional area, the duct having a rectangular duct cross section at a proximal zone adjacent the intake passage and having a circular duct cross section at a distal zone remote from the intake passage, the duct cross section gradually changing from rectangular to circular between the proximal zone and the distal zone.

2. The hydraulic motor of claim 1 wherein: the duct includes a first transitional zone adjacent the proximal zone; the duct cross section in the first transitional zone defines an essentially rectangular shape having a smaller length-to-width ratio than the rectangular duct cross section in the proximal zone; and adjacent to the first transitional zone is a second transitional zone where the duct cross section is essentially oval.

3. The hydraulic motor of claim 2 wherein the rectangular shape of the duct cross section in the first transitional zone is disposed at an obique angle to the rectangular cross section of the intake passage.

4. The hydraulic motor of claim 3 wherein the rectangular shapes of the duct cross sections in the first transitional zones are disposed at an oblique angle to the rectangular cross sections of the intake passages.

5. A hydraulic motor comprising a housing having two parallel side walls, an inner surface of one side wall disposed in a first parallel plane and an inner surface of another side wall disposed in a second parallel plane; a circumferential wall connecting the side walls; the interior surface of the circumferential wall and the side walls together defining a flat epitrochoidal cavity; a rotor disposed within the housing rotating on on a central axis normal to the housing side walls; the rotor comprising a cylindrical hub having radial slots and a radial vane slidably disposed in each slot; the diameter of the cylindrical hub being the same as the minor dimension of the epitrochoidal cavity, the housing and rotor defining segmental working chambers:

the improvement comprising liquid intake means for minimizing turbulence and restrictions in the flow of liquid into the housing, the liquid intake means comprising an intake passage defined by the housing circumferential wall, the intake passage having a generally rectangular cross section terminating in a rectangular intake port on a wall interior surface; the intake port spanning substantially the entire distance between the two housing side walls; the liquid intake means further comprising a connector affixed to the housing having an intake duct therethrough such that the intake duct and the intake passage together form one smooth, continuous passage having a constant cross sectional area, the intake duct having a rectangular duct cross section at a proximal intake zone adjacent the intake passage and having a circular duct cross section at a distal intake zone remote from the intake passage, the intake duct cross section gradually changing from rectangular to circular between the proximal intake zone and the distal intake zone;

the improvement further comprising liquid exhaust means for minimizing turbulence and restrictions in the flow of liquid from the housing, the liquid exhaust means comprising an exhaust passage defined by the housing circumferential wall, the exhaust passage including a generally rectangular cross section having a rectangular exhaust port on the wall interior surface; the exhaust port spanning substantially the entire distance between the two housing side walls; the liquid exhaust means further comprising an exhaust duct defined by the connector and passing through the connector such that the exhaust duct and the exhaust passage together form another smooth, continuous passage having a constant cross sectional area, the exhaust duct having a rectangular duct cross section at a proximal exhaust zone adjacent the exhaust passage and having a circular duct cross section at a distal exhaust zone remote from the exhaust passage, the exhaust duct cross section gradually changing from rectangular to circular between the proximal exhaust zone and the distal exhaust zone;

the ducts each disposed between the first and second parallel planes, the ducts each undergoing a gradual angular and directional change between their distal zones and their proximal zones so that the ducts curl around each other between the first and second parallel planes;

a minor-axis plane containing all points of the central axis and all points of the minor axis of the epitrochoidal chamber, the minor-axis plane passing between the intake passage and the exhaust passage and passing through the connector; the intake duct crossing the minor-axis plane such that the proximal intake zone is on one side of the minor-axis plane and the distal intake zone is on an opposite side of the minor-axis plane; the exhaust duct crossing the minor-axis plane such that the proximal exhaust zone is on the opposite side of the minor-axis plane and the distal exhaust zone is on the one side of the minor-axis plane.

6. The hydraulic motor of claim 5 wherein: the intake duct includes a first transitional zone adjacent the proximal intake zone; the cross section of the first transitional zone is an essentially rectangular shape having a smaller length-to-width ratio than the cross section of the intake proximal zone; and adjacent to the first transistional zone is a second transitional zone where the duct cross section is essentially oval.

7. The hydraulic motor of claim 6 wherein: the ducts each include a first transitional zone adjacent the proximal zones; the ducts in the first transitional zones define an essentially rectangular shape having a smaller length-to-width ratio than the rectangular duct cross sections in the proximal zones; and the ducts include second transitional zones adjacent the first transitional zones where the duct cross sections are essentially oval.

8. The improvement of claim 6 wherein the circumferential dimension of the intake port measures no more than twenty degrees from the central axis.

9. The improvement of claim 8, wherein the axial dimension of the intake passage is at least twice the its circumferential dimension.

10. The improvement of claim 7 wherein the circumferential dimension of the intake port measures no more than twenty degrees from the hub element rotational axis.

11. The improvement of claim 10, wherein the axial dimension of the intake passage is at least twice its circumferential dimension.

* * * * *